United States Patent [19]

Huat

[11] Patent Number: 4,696,414

[45] Date of Patent: Sep. 29, 1987

[54] DISCHARGE ASSEMBLY

[76] Inventor: Mok K. Huat, Building 205, Jurong East St. 21,03,139, Singapore, Singapore

[21] Appl. No.: 799,004

[22] Filed: Nov. 18, 1985

[30] Foreign Application Priority Data

Nov. 21, 1984 [GB] United Kingdom ..... 8429360

[51] Int. Cl.[4] ..... B67D 5/08

[52] U.S. Cl. ..... 222/67; 222/306; 222/308; 222/363; 222/366; 4/227

[58] Field of Search ..... 4/228, 227, 226; 222/308, 307, 306, 305, 366, 363, 367, 361, 434, 438, 440, 67, 64

[56] References Cited

U.S. PATENT DOCUMENTS

| | | | |
|---|---|---|---|
| 2,339,908 | 1/1944 | Brewer et al. | 222/308 X |
| 2,587,388 | 2/1952 | Ryder, Jr. | 4/227 |
| 3,019,451 | 2/1962 | Wooldridge | 222/305 X |
| 4,285,074 | 8/1981 | Leinberry | 4/227 |

FOREIGN PATENT DOCUMENTS

| | | | |
|---|---|---|---|
| 974648 | 2/1951 | France | 4/228 |
| 211311 | 2/1924 | United Kingdom | 4/228 |
| 613064 | 11/1948 | United Kingdom | 4/228 |

*Primary Examiner*—Joseph J. Rolla
*Assistant Examiner*—David H. Bollinger
*Attorney, Agent, or Firm*—Irving M. Weiner; Joseph P. Carrier; Pamela S. Burt

[57] ABSTRACT

A dispensing valve provided in a chemical dispenser for dispensing predetermined amounts of chemical into a lavatory cistern is disclosed. The dispensing valve seals an opening in and dispenses liquid from the dispenser, the valve having a chamber movable through the opening between a filling position in which the chamber is fillable with chemical from the dispenser and a discharge position in which chemical held in the chamber may be discharged, the chamber being provided with surfaces sealing the opening in both said positions and further having an adjustable filling volume.

12 Claims, 9 Drawing Figures

DISCHARGE ASSEMBLY

This invention relates to a discharge assembly more particularly, but not exclusively, to a discharge assembly usable with a chemical dispenser for discharging an amount of lavatory cleaner held in the dispenser to a lavatory cistern after each flush.

Lavatory chemical dispensers have been progressed, for example, as manufactured as under the trade name "Depend-O" in which a valve assembly attached to a bottle of toilet cleaning chemical, is used to dispense an amount of chemical into a lavatory after each flush. The valve mechanism is opened, under the action of gravity, when the cistern is flushed, and is closed by a bouyancy force, generated in an inverted cup-shaped member which retains air when the cistern is full of water, to push the valve member into the closed position.

The valve mechanism is arranged to restrict the amount of chemical dispensed by using an external sleeve-shaped holding, member attached to the valve. The holding member fills up with chemical which drips out of the bottle when the valve is opened. The chemical is replaced by air entering the bottle from the cistern through the top of the holding member, until the chemical filling the holding member blocks the air passage into the bottle at which time the flow of chemical into the holding member stops. The chemical is dispensed from the holding member by displacement when the valve is closed.

It is a disadvantage of such a proposed dispenser that the amount of chemical dispensed is not precise.

It is a further disadvantage that the dispenser is unsuitable for use in both big and small tanks.

According to the invention there is provided a dispensing valve for a container comprising: a valve seat having means defining a first opening therein, a chamber having means defining a second opening therein. the chamber being movable relative to the valve seat between a filling position in which the chamber is fillable with liquid from the contained through the second opening and a discharge position in which liquid in the chamber may be discharged through the second opening: first and second sealing surfaces between which the chamber is disposed, said surfaces sealing the first opening in said filling and discharged position respectively; and a tapered outlet groove connected to the second opening.

The provision of the tapered outlet groove, connect to the chamber opening allows pressure within the container to be adjusted after each flush operation. This prevents the build up of a substantial vacum within the container. The applicant has found that the build up of such a vacum results in a decrease of chemical discharge after each flush to such time as the air pressure within the dispenser bottle is so far out of proportion that the bottle returns to its original shape by sucking in air through the sides of the chamber. The provision of the outlet groove alleviates this and allows a highly consistent chemical discharged rate to be achieved.

It is a further preferred feature of the invention that the liquid transfer volume of the chamber is adjustable.

An embodiment of the invention will now be described by way of example with reference to the accompanying drawings in which.

Figure 1:
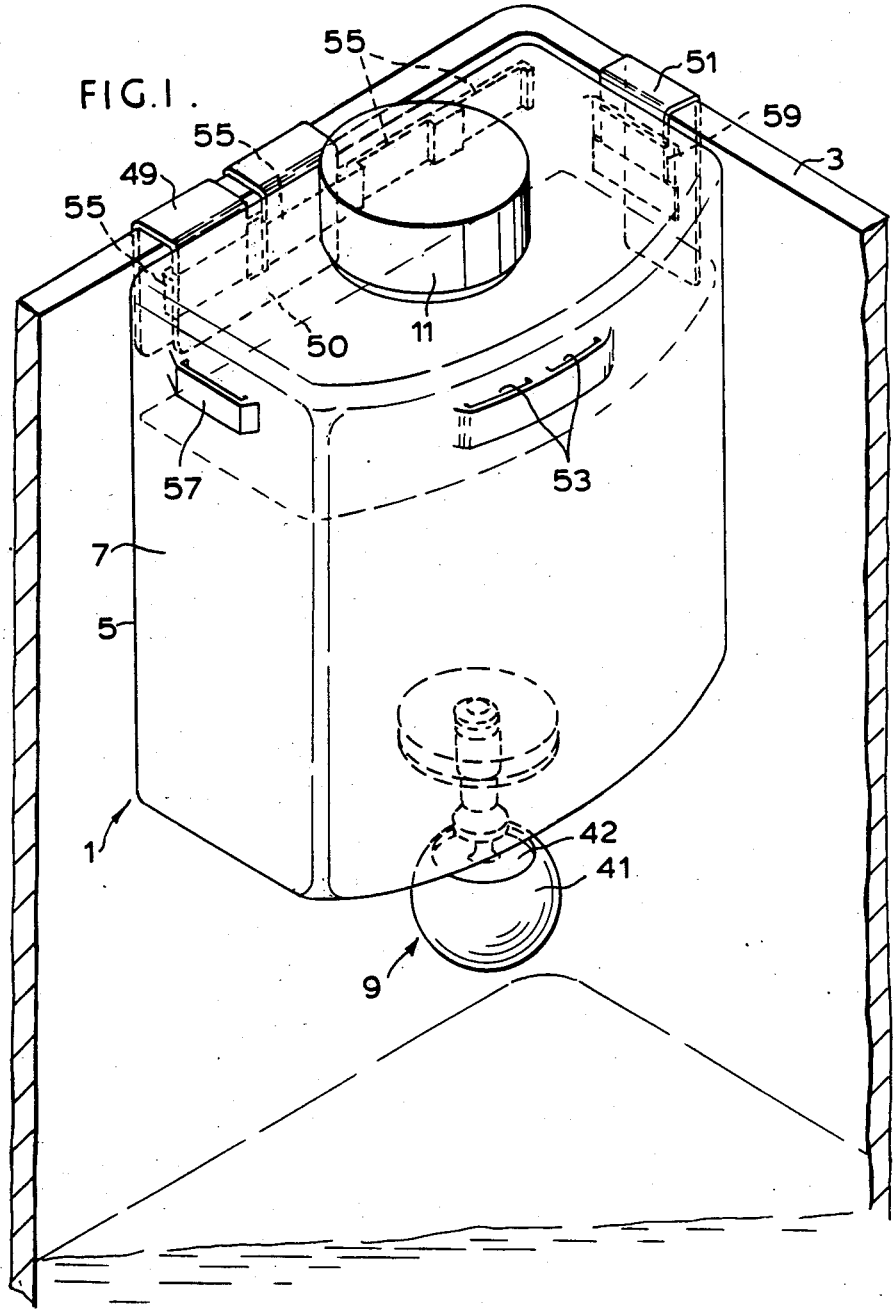
FIG. 1 is a prespective view of a chemical dispenser incorporating the invention.

FIGS. *6a* and *6b* show detail of the mounting pieces, for mounting the dispenser shown in FIG. 1 on the cistern side.

Figure 7:
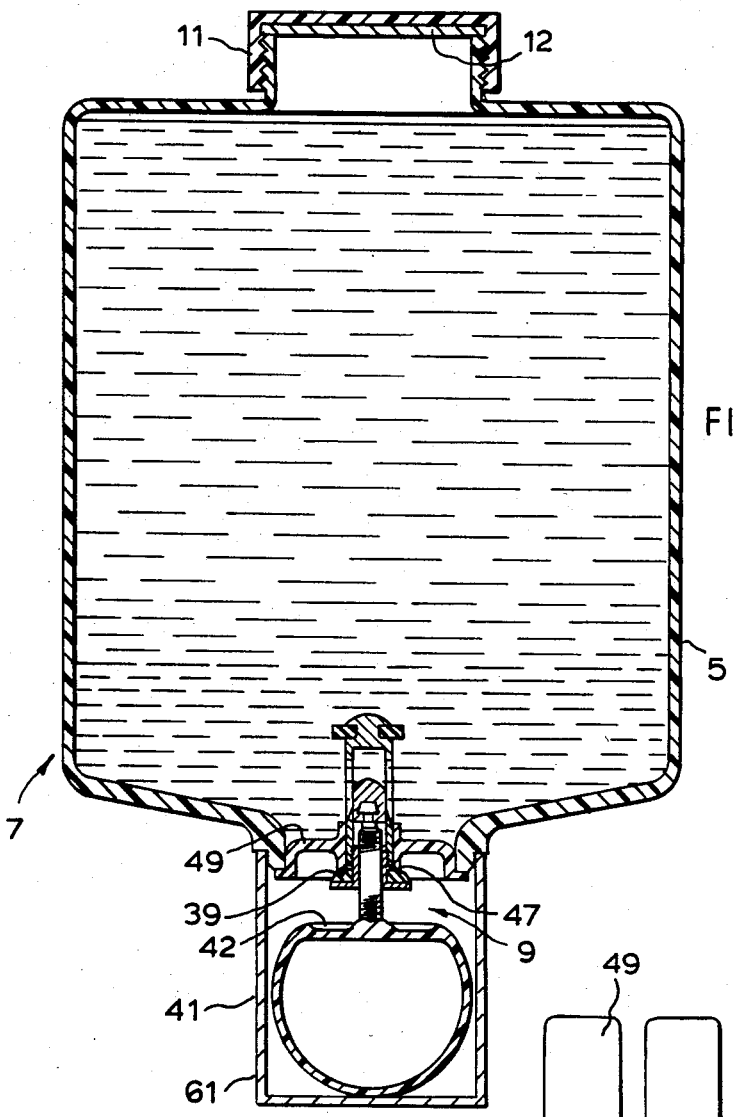

FIG. 7 shows detail of a packaging arrangement for the embodiment of FIGS. 1 to 6.

Figures 2, 3:
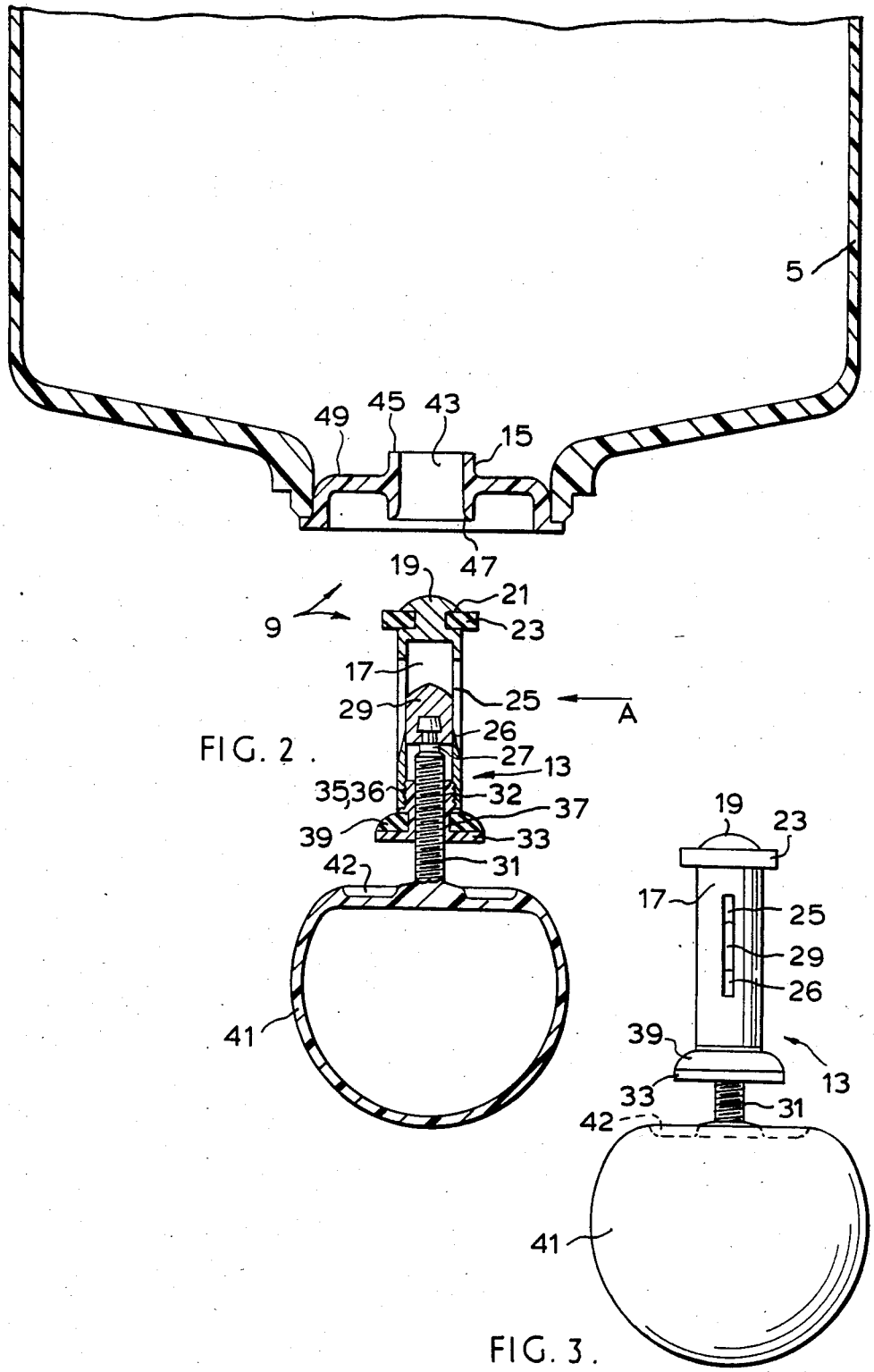
FIG. 2 is an exploded cross-sectional view of the discharge assembly taken along the line 2—2′ of FIG. 1.
FIG. 3 is a non-sectional view taken in the direction of arrow A of FIG. 2.
Figure 8:
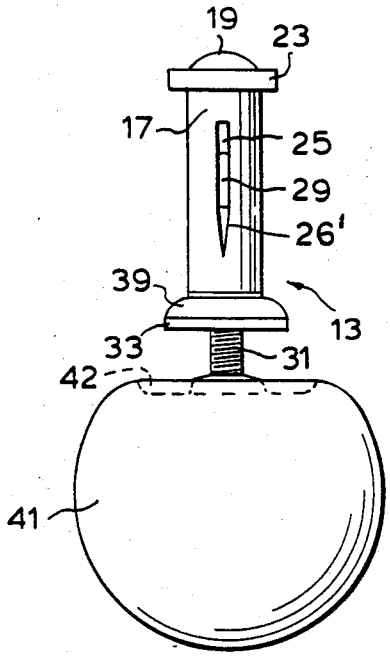

FIG. 8 illustrates a modification of the discharge assembly shown in FIG. 3.

With reference to FIG. 1, a chemical dispenser generally designated 1 is shown. The dispenser 1 is attached to the side of a lavatory cistern 3, in a manner to be described later. The dispenser 1 includes a liquid chemical container 5 which is filled with liquid cleaning and deodorising chemical 7. The dispenser 1 is provided at its base, with a discharge assembly 9, through which the chemical 7 is discharged into the cistern 3 every time the cistern 3 is flushed. The container 5 is further provided with a stopper 11 which allows the dispenser 1 to be refilled with chemical 7 as necessary. The stopper 11 affects an airtight seal and is. prefereably screw threaded, the seal being provided by a piece of silicone material 12 inside the cap 11. (For detail, see FIG. 7).

The discharge assembly 9 will be described in greater detail with reference to FIGS. 2 to 5. In FIG. 2, the assembly 9 is shown in cross section. As illustrated, the assembly 9 includes a valve member 13 and a valve seat 15.

The valve member 13 includes a transporting chamber 17 of hollow, cylindrical form, having two eleongate openings 25 formed in the sides thereof which includes a cap 19. The cap 19 is provided with an annular groove 21 into which a silicone material washer 23 is fitted.

The chamber 17 is further provided with a adjustable silicone rubber plunger assembly 27 which includes a plunger 29, attached to a threaded member 31. The threads of the threaded member 31 engage with corresponding threads in a end piece 33, which is attached to the chamber 17 by means of complimentary threaded portions 35, 36. The inner threads 31, 32 and outer threads 35, 36 are arranged to be contra rotaing, as described below.

The end piece 33 is further provided with an annular groove 37 in which a further silicone washer 39 is fitter. The washer 39 has a beveled surface as shown.

A float 41 is preferably formed in one piece with the threaded member 31. The float 41 is provided with an annular depression 42 in its upper surface.

Turning to the valve seat 15, this is provided with a cylindrical opening 43 of sufficient diameter to accomodate the chamber 17 with a slight clearance. As will be described below, in use the valve member 13 moves between its discharge position, in which silicone washer 23 abuts against surface 45 of the valve member 15, and a fill-up position in which silicone washer 39 abuts against slightly beveled surface 47 of the valve seat 15. The valve seat 15 is formed as part of a stopper 49 which engages, in a press fit with the chemical container 5.

The working of the chemical dispenser 1, and in particular the discharge dispenser 1, and in described with reference to FIGS. 4 and 5.

Figure 4:
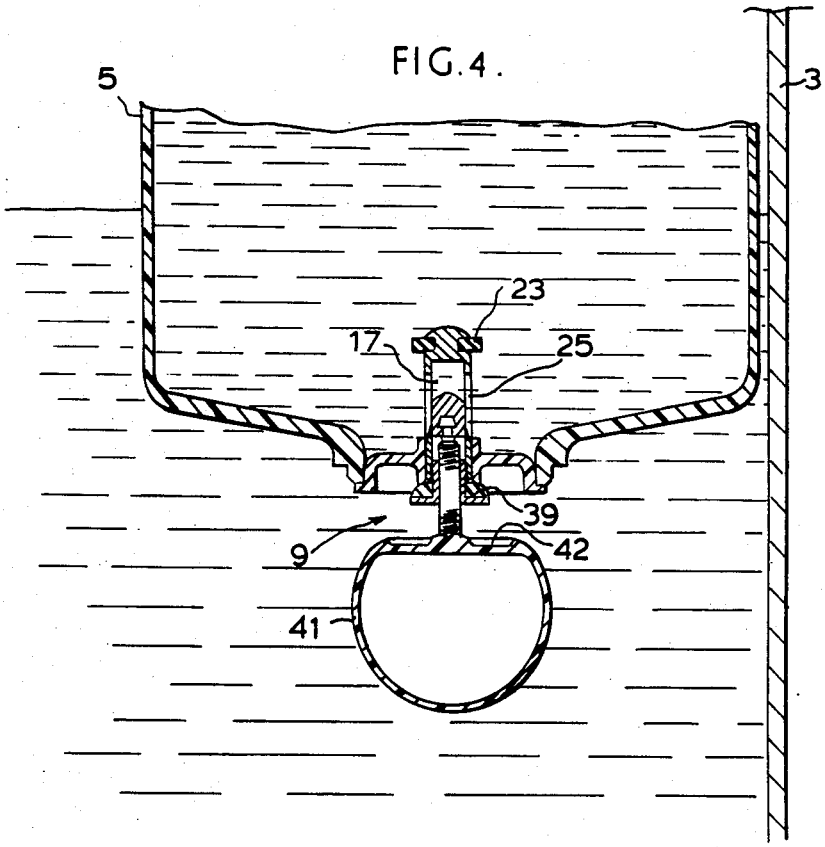
FIG. 4 and 5 show the embodiment of FIGS. 1 to 3 in use.

With reference to FIG. 4, the dispenser 1 is shown positioned in the cistern 3, prior to flushing. The float 41 holds the discharge assembly 9 in the fill-up position as shown. The silicone washer 39 abuts against surface 47, to form a seal preventing seapage of chemical 7 out through the discharge assembly 9. The chemical 7, however, fills the chamber 17, through the openings 25.

Figure 5:
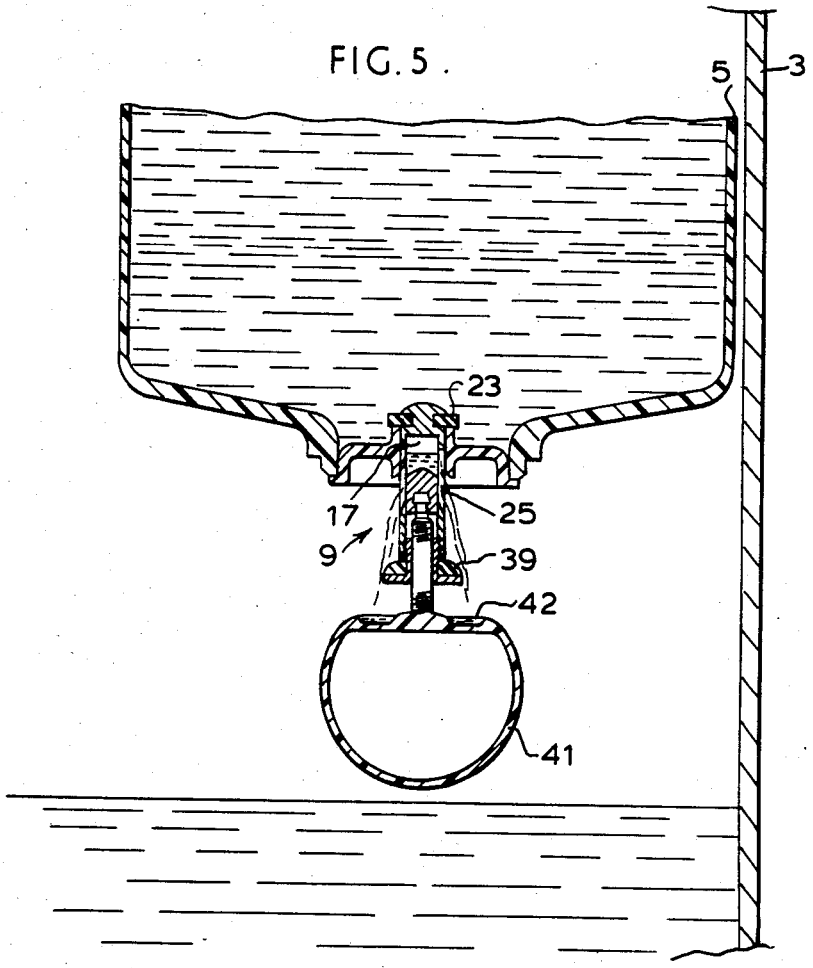

When the cistern 3 is flushed the water level decreases as shown in FIG. 5. The float 41 then ceases to exert a force holding the discharge assembly 9 in the fill-up position and the assembly 9 descends to the position shown in FIG. 5, in which the silicone washer 23 abuts against surface 45 thus preventing chemical 7 from escaping from the container 5 into the cistern 3. However, the amount of chemical 7 held in the transporting chamber 17 is transferred out of the container 5 and into the annular depression 42 through openings 25, as shown. Any small amount of chemical which overflows out of the depression 42 is discharged into the water at the end of the flush and forms a concentrated solution of chemical to aid cleaning of the lavatory bowl.

The volume of the chamber 17 can be adjusted by rotation of the float and threaded member 31 relative to the end piece 33, so that the plunger 29 moves in or out accordingly. As previously mentioned, the threaded members 31, 32 have contra rotating threads to the threaded members 35, 36, this allows the plunger 29 to be moved outwardly without unscrewing the end piece 33. The plunger 33 is preferably pre-adjusted during manufacture to the minimum release position so that there should only be a requirement to increase the release of chemical. Adjustment of the amount of chemical allows the dispenser 1 and discharge assembly 9 to be uniformly effective in a wide variety of sizes of tank. Preferably, the transporting chamber is formed from, translucent plastics material, for example polyethylene or nylon, so that the level of the plunger 29 is viewable through the chamber 17, the chamber 17 being marked with graduations indicating the preferred position of the plunger 29, for given sizes of cistern tank.

When the cistern refills, the water is coloured by the chemical previously released into the depression 42 and the float 51 moves up under action of the water pressure to displace the discharge assembly 9 into the fill-up position as shown in FIG. 4.

Figures 6A, 6B:
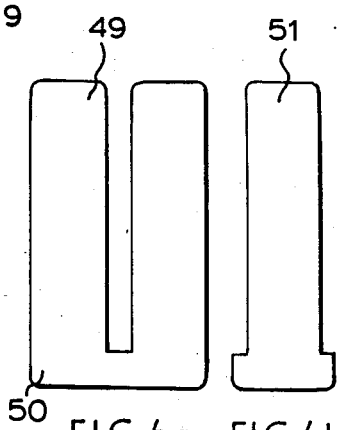

With reference to FIG. 6, holding pieces 49, 51 are shown. The holding pieces 49, 51 support the dispenser 1 relative to the side of the cistern 3, as shown in FIG. 1. The container 5 is provided with slots 53, 55, 57 and 59 formed on the sides of the container. Slots 53, 55 are arranged to receive the U-shaped holding piece 49, the base 50 of the U, abutting against the lower sides of two of the slots 55, the projecting ends of the U being bent so that the holding piece 49 hooks around the cistern 3. Similarly, the inverted T holding piece 51 engages in either of the slots 57, 59 and is bent to hook onto another side of the cistern 3. The holding piece provides greater support, but it is not essential, for holding the dispenser 51 in place. A plurality of openings 55 are provided so that the holding piece may have an adjustable position in case of obstruction at the side of the cistern 3.

The container 5 is provided with a flat side surface, in which openings 55 are disposed and an arcuate side surface in which openings 53 are disposed. The different side surfaces allow the dispenser 1 to fit against both flat-sided and arcuate sided cistern tanks. The arcuate side preferably forms an arc of a 30 centimeter diameter circle.

With reference to FIG. 7 the dispenser 1 is shown, having a cap 61 attached thereto. The cap 61 is frictionally fitted onto the container 5 and is of sufficient size to exert a slight force against the float 41 of the discharge assembly 9. This in turn acts on the silicone washer 39, which seals the container against surface 47 so that during transit and when on display, in a shop for example, the dispenser 1 is sealed to prevent seapage of chemical.

The container 5 is preferably manufactured from polyethylene. The remaining working parts with the exception of the silicone washers and the plunger are also preferably manufactured from plastics or other corrosion resistant, materials, for example polyethylene or nylon.

The float 41 may be replaced by a inverted cup-shaped member which traps air beneath it, when the cistern refills, so as to act as a float.

Grooves 36 are provided, extending from each opening 25, each groove 26 reducing in cross-section away from the opening 25. The grooves may be tapered to a point, as shown in FIG. 8.

I claim:

1. A dispensing valve for a container comprising: a valve seat having means defining a first opening therein, a chamber having means defining a second opening therein, the chamber being movable relative to the valve seat between a filling position in which the chamber is fillable with liquid from the container through the second opening and a discharge position in which liquid in the chamber may be discharged through the second opening: first and second sealing surfaces between which the chamber is disposed, said surfaces sealing the first opening in said filling and discharge position respectively; a groove connected to and extending from the second opening, the groove reducing in cross sectional area away from the second opening and being arranged so that air may pass through the groove and second opening during movement of the chamber from the discharging to the filling position; a member movable in the chamber so as to adjust the volume thereof; and wherein the distance between the sealing surfaces remains constant independent of the volume of the chamber.

2. A valve as claimed in claim 1 wherein the first sealing surface comprises a sealing member formed from elastomeric material.

3. A valve as claimed in claim 2 wherein the second sealing surface comprises a further sealing member formed from elastomeric material.

4. A valve as claimed in claim 1 wherein the member and chamber are connected through complimentary threaded portions so that relative rotations of the chamber and the member causes adjustment of said volume.

5. A valve as claimed in claim 1 further comprising float means connected to the chamber.

6. A valve as claimed in claim 5 further comprising a depression provided in the float means arranged so that liquid discharged from the chamber is received in the depression.

7. A valve as claimed in claim 6 wherein the depression is smaller in volume than the chamber so that chemical discharged from the chamber both fills and overflows out of the depression.

8. A dispenser comprising, in combination, a container for liquid and a valve as claimed in claim 1.

9. A dispenser as claimed in claim 8 further comprising means for attachment of the container to the side of a lavatory system, one of the sides of the container being arcuate and another of the sides of the container being flat.

10. A dispenser as claimed in claim 8 further comprising a cap arranged to force the first sealing surface into a sealing position against the valve seat.

11. A dispenser as claimed in claim 8 wherein the container is provided with means defining a plurality of openings and further comprising a holding member, the holding member being connected to said means at a selected said opening and being bendable to a shape for hooked engagement with a cistern tank.

12. A dispensing valve as claimed in claim 1 wherein the groove is tapered.

* * * * *

UNITED STATES PATENT AND TRADEMARK OFFICE

CERTIFICATE OF CORRECTION

PATENT NO. : 4,696,414

DATED : September 29, 1987

INVENTOR(S) : Mok K. HUAT

It is certified that error appears in the above-identified patent and that said Letters Patent is hereby corrected as shown below:

Column 1, line 9, change "progressed" to --proposed--;
line 39, after "therein" change the period to a comma;
line 42, change "contained" to --container--;
line 50, change "connect" to --connected--;
line 53, correct the spelling of --vacuum--;
line 55, correct the spelling of --vacuum--;
line 67, change "prespective" to --perspective--.

Column 2, line 5, change "FIG." to --FIGS.--
line 19, correct the spelling of --deodorizing--;
line 25, correct the spelling of --preferable--.
lines 35-36, correct the spelling of --elongate--.
line 40, change "a" to --an--;
line 44, change "a" to --an--;
line 47, correct the spelling of --rotating--;
line 50, change "fitter" to --fitted--;
lines 56-57, correct the spelling of --accommodate--.
line 67, change "dispenser 1, and in" to --assembly 9, will now be--.

Column 3, line 58, after "piece" insert --51--;
line 60, change "51" to --1--.

UNITED STATES PATENT AND TRADEMARK OFFICE

CERTIFICATE OF CORRECTION

PATENT NO. : 4,696,414

DATED : September 29, 1987

INVENTOR(S) : Mok K. Huat

It is certified that error appears in the above-identified patent and that said Letters Patent is hereby corrected as shown below:

Column 4, line 21, change "36" to -- 26 --.

Signed and Sealed this

Twelfth Day of April, 1988

*Attest:*

*Attesting Officer*

DONALD J. QUIGG

*Commissioner of Patents and Trademarks*